United States Patent [19]

Wruck

[11] Patent Number: 5,000,601

[45] Date of Patent: Mar. 19, 1991

[54] SMOOTH DRIVE COSMETIC CONTAINER

[75] Inventor: Keith R. Wruck, Shelton, Conn.

[73] Assignee: The Bridgeport Metal Goods Manufacturing Company, Bridgeport, Conn.

[21] Appl. No.: 407,761

[22] Filed: Sep. 19, 1989

[51] Int. Cl.[5] ..... A45D 40/06

[52] U.S. Cl. ..... 401/78; 401/86; 401/80

[58] Field of Search ..... 401/80, 78, 86, 75, 401/77

[56] References Cited

U.S. PATENT DOCUMENTS

| | | | |
|---|---|---|---|
| 1,974,418 | 9/1934 | Cornell | 401/78 |
| 2,352,448 | 6/1944 | Reichenbach | 401/78 |
| 2,419,526 | 4/1947 | Anderson | 401/86 |
| 2,814,384 | 11/1957 | Dulberg | 401/78 |
| 2,982,397 | 5/1961 | Wahle | 401/86 |
| 3,308,939 | 3/1967 | Sakalys | 401/78 |
| 3,323,641 | 6/1967 | Landen | 401/86 |
| 3,623,821 | 11/1971 | Gould | 401/86 |
| 3,653,776 | 4/1972 | Geisel | 401/86 |
| 4,422,545 | 12/1983 | Kadoory | 206/45.34 |
| 4,514,102 | 4/1985 | Ackerman et al. | 401/78 |
| 4,603,989 | 8/1986 | Ackerman | 401/78 |
| 4,690,578 | 9/1987 | Idec | 401/78 |
| 4,792,251 | 12/1988 | Ryder | 401/74 |
| 4,812,066 | 3/1989 | Gueret | 401/78 |

*Primary Examiner*—Richard J. Johnson

*Attorney, Agent, or Firm*—Parmelee, Bollinger & Bramblett

[57] ABSTRACT

A lipstick container is disclosed having an inner body member with an upper tubular portion. An outer body member surrounds the tubular portion and is mounted thereon for relative rotation thereabout. A base member surrounding the outer body member is in fixed engagement with the inner body member. A slidable cup received in the tubular portion carries the lipstick mass. Relative rotation between the inner body member and the outer body member moves the slidable cup between a protracted position and a retracted position. A central ring partially surrounding the outer body member and secured to the base member includes a plurality of projecting biased elements for engaging the outer surface of the outer body member to provide a radial force thereon whereby an approximately constant torque is required to enable relative rotation therebetween.

12 Claims, 2 Drawing Sheets

50
46
52
16
12
38
42
50
26
58
54
54
62
64
62
52
18
38
10
40
30
20
60
66
22
14
56
14
28

SMOOTH DRIVE COSMETIC CONTAINER

BACKGROUND OF THE INVENTION

The present invention relates generally to lipstick containers, and more particularly to lipstick containers having mechanical mechanisms for manipulating their associate lipstick masses longitudinally within the containers between extended and retracted positions.

Lipstick containers having mechanisms for manipulating their associated lipstick masses are well-known in the art. The prior art containers generally have a main inner body member with a finger engaging knob or base portion at one end thereof and a tubular sleeve at the other end thereof. Extending longitudinally in the tubular sleeve are a pair of diametrically opposed elongated slots with locking portions at their terminal ends.

Mounted within the tubular sleeve is a cup adapted to receive the lipstick mass and having a pair of diametrically opposed, outwardly extending posts captured in the pair of slots in the tubular sleeve. The posts are also captured in a pair of helical or spiral grooves formed in the inner wall of an outer sleeve which surrounds the tubular sleeve of the inner body member. The inner body member and the outer sleeve are mechanically retained to one another at their upper ends by a conventional lip and groove arrangement which permits relative rotational movement therebetween.

In operation, relative rotation between the inner body member and the outer sleeve forces the captured posts of the cup member to follow both the longitudinal slots of the inner body member and the helical grooves of the outer sleeve to move the cup element longitudinally in the inner body member, alternatively, between its retracted locked position completely within the inner body member and its protracted locked position extending partially outside the inner body member. In its retracted locked position, the posts of the cup member are located within the lower locking portions (adjacent the knob or base portion) of the longitudinal slots; the cup being thereby inhibited from longitudinal movement during transportation and handling of the lipstick container. In its protracted locked position, inadvertent downward movement of the cup is inhibited during both the loading of the lipstick mass into the container during the assembly process and the application of associated lipstick onto a user's lips.

One of the problems which has been encountered in the use and manufacture of such containers is wide, undesirable variations in the torque required to control the relative rotation of the inner body member and the outer sleeve to drive the cup element between the retracted and protracted positions.

Torque for lipstick container is generally measured in inch-ounces with the ideal range of acceptability being two (2) to six (6) inch ounces. To achieve this range in the prior art lipstick containers, a variety of methods have been used including manufacturing the cup element to have an outer diameter slightly larger than the inner diameter of the main body member whereby the cup member tends to resist longitudinal movement within the inner body member. In practice, due to manufacturing inaccuracies, such as encountering non-uniform inner diameters of the main body member as the cup element moves axially therethrough, the torque found in the prior art devices tends to range from one to thirteen inch-ounces and can vary dramatically over the stroke of the cup element between its retracted and protracted positions. Oftentimes, the containers with torques at the upper end of this range are nearly inoperable and must be rejected and discarded as having unacceptably high torques.

Other prior art methods for controlling torque, such as those disclosed in U.S. Pat. No. 4,514,102 provide a smoothness of rotational action However, the design disclosed in the U.S. Pat. No. 4,514,102 patent has the undesirable quality of incorporating a cylindrical collar which is relatively rigid and unable to adequately accommodate large variations in sizes due to the tolarances inherent in the manufacturing process.

Another prior art design, U.S. Pat. No. 4,792,251 produces a smooth operating mechanism but requires an additional element, i.e. a friction ring, which adds to the expense in manufacturing and assembling the container.

It is a problem underlying the present invention to provide a lipstick container which utilizes a limited number of parts while still providing an ultrasmooth, operating mechanism.

It is an object of the present invention to provide a lipstick container which overcomes the limitations and failings of the prior art designs.

It is a further object of the present invention to provide a lipstick container which has a uniform torque throughout the length of its stroke to create an ultrasmooth operating mechanism.

It is a still further object of the present invention to provide a lipstick container which is relatively inexpensive to fabricate and assemble.

SUMMARY OF THE INVENTION

Accordingly, there is provided a lipstick container containing an inner body member having a lower portion and an upper tubular portion. The tubular portion has at least one longitudinal extending slot formed therethrough. An outer body member at least partially surrounds the tubular portion of the inner body member and is mounted thereon for relative rotation thereabout. The outer body member has at least one spiral groove on an interior surface adjacent the tubular portion. A base member at least partially surrounds the outer body member and is in fixed engagement with the inner body member. A slidable cup is adapted to carry a lipstick mass. The cup is received in the tubular portion and has at least one post extending through the one longitudinal slot in the tubular portion and into the spiral groove in the outer body member whereby relative rotation between the inner body member and the outer body member moves the slidable cup between a protracted position and a retracted position. A central ring or band at least partially surrounds the outer body member and is secured to one end of the base member. The central ring includes a plurality of projecting biased elements extending therefrom for engaging at least a portion of the outer surface of the outer body member to provide a radial force on the outer body member whereby an approximately constant torque is required to enable relative rotation therebetween.

Conveniently, a protective cover is releasably engaged with the outer body member and removably positioned over at least a portion of the central ring. The cover has an insert therein for holding the cover and the outer body member in assembly when the cover is fully seated on the outer body member. The cover central ring and outer body member are cooperatively dimensioned so that the cover is removably positioned over the central ring whenever the cover is releasably engaged with the outer body member.

The invention will be more fully understood when references is made to the following detailed description taken in conjunction with the accompanying drawings.

BRIEF DESCRIPTION OF THE DRAWINGS

The same reference numerals refer to the same elements throughout the various Figures.

DETAILED DESCRIPTION OF THE PREFERRED EMBODIMENT

Figures 1, 2:
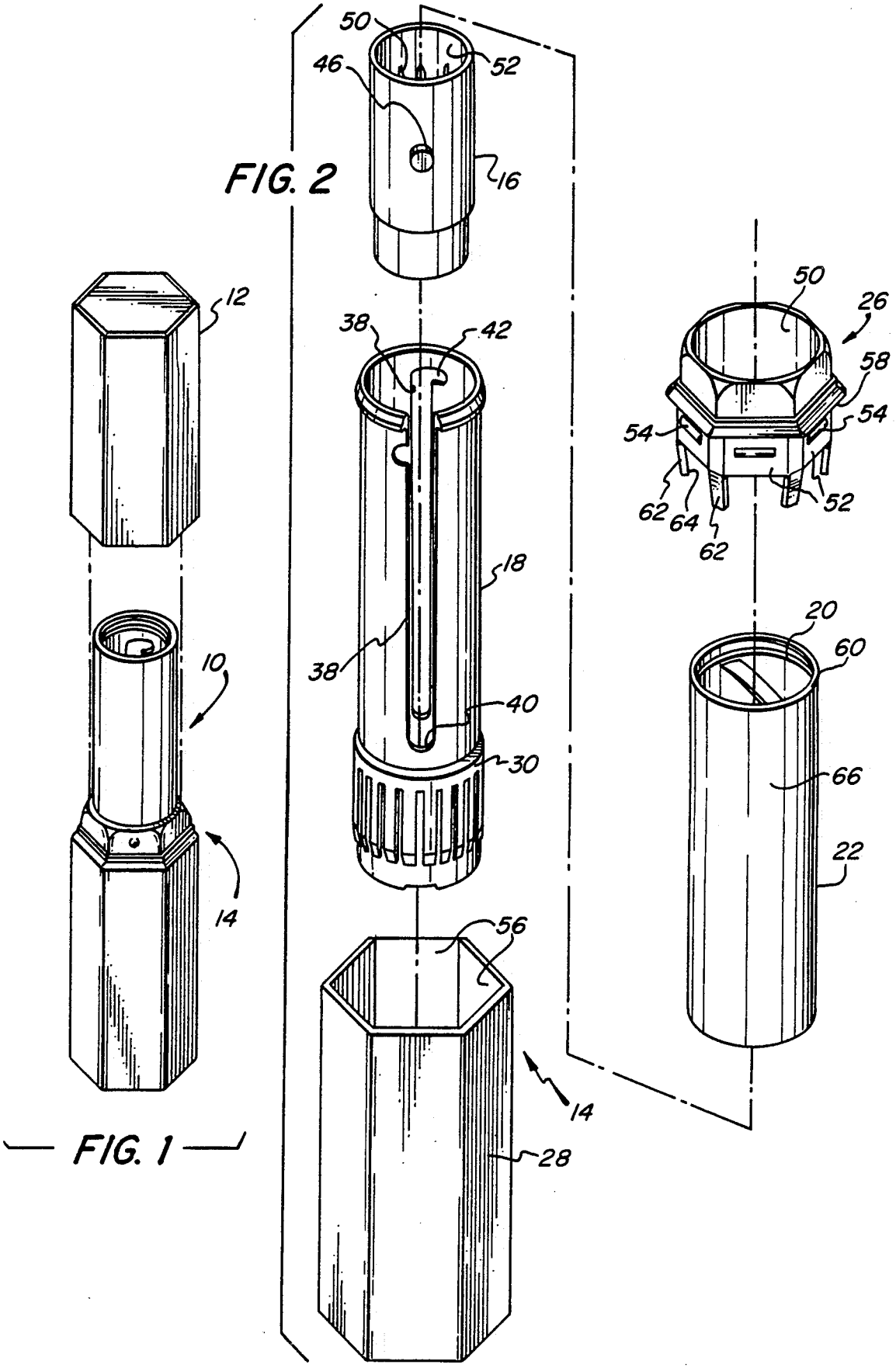
FIG. 1 is a perspective view of a lipstick container according to the invention herein.
FIG. 2 is an enlarged exploded perspective view of the lipstick container of FIG. 1 without the protective cover assembly.

Referring first to FIG. 1, therein is illustrated a lipstick container 10 according to the invention herein and generally comprising two main assemblies which are a protective cover assembly 12 and a main body assembly 14. As can be appreciated from FIG. 1, the lipstick container has a hexagonal configuration. However, it is within the scope of the present invention to manufacture the container with any shape such as but not limited to square, octagonal, cylindrical or oval.

Turning now to FIG. 2, the main body assembly 14 preferably comprises a cup member 16, an inner tubular body member 18, a spiral body member 20, an outer body member 22, a central ring member 26, and noncircular base cap 28. The inner body member 18, illustrated in detail in FIG. 3, has an enlarged portion 30 open at its lower end, with a shoulder 32 on its upper end from which extends an upper, reduced dimensioned tubular sleeve portion 34. Formed within the upper portion 34 are a pair of diametrically opposed, longitudinally extending slots 38. The slots 38 terminate short of shoulder 30 at their lower terminal ends. The slots 38 include upper lock extension portions 42 which are diametrically opposed and extend in a circumferential direction. The inner body member 18 is secured into the base member 28 by element 39 which is formed in the base member 28 as seen in FIG. 3.

Figure 3:
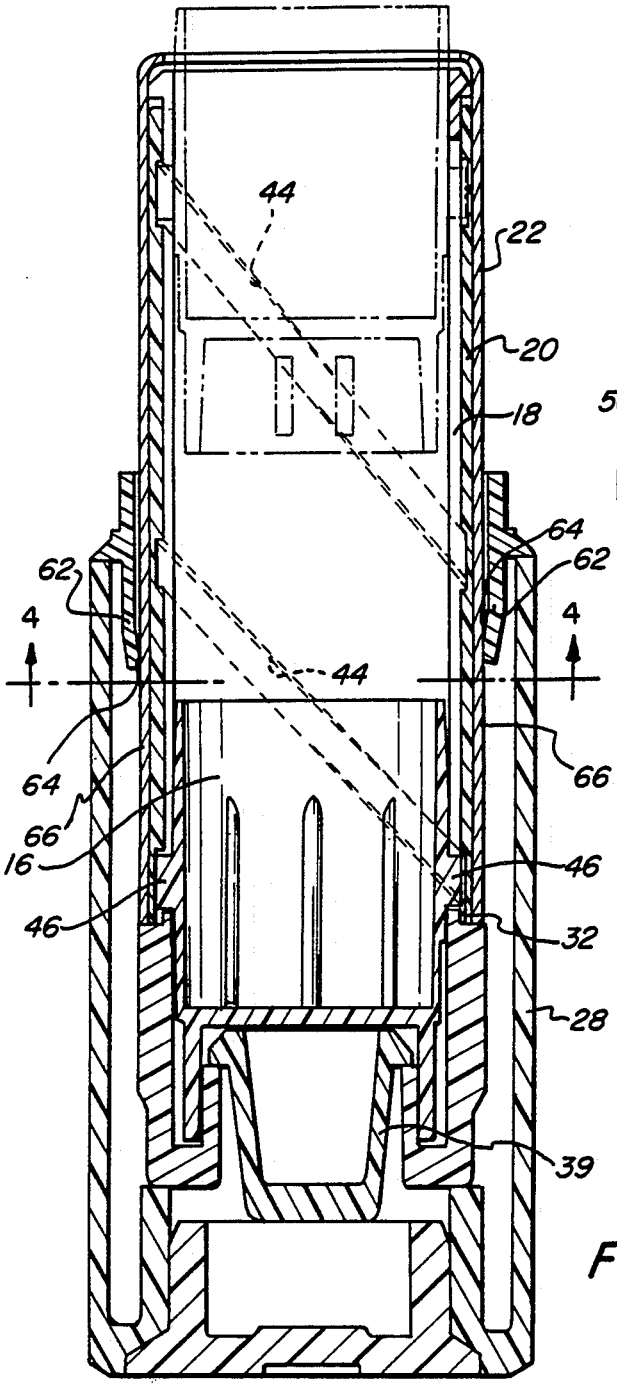
FIG. 3 is an enlarged side view of the lipstick container without the protective cover assembly in cross section.

Referring now to FIGS. 2 and 3, the spiral body member 20, molded from a plastic material to have a circular configuration, is concentrically mounted about the upper reduced dimensioned portion 32 whereby the spiral body member 20 and the inner body member 18 are relatively rotatable with respect to one another. As best seen in FIG. 3, on the inner surface of the spiral body member 20 is a pair of intertwined spiral grooves or tracks 44 which terminate short of the ends of the spiral body member 20.

Mounted for longitudinal sliding movement within the inner body member 18 is the cup member 16 which can be constructed of any material, such as a molded plastic and has a pair of diametrically opposed, outwardly directed posts 46 extending through the slots 38 of the inner body member 18 and captured in the spiral tracks 44 of the spiral body member 20. Thus, as easily understood by those skilled in the art, relative rotation between the inner body member 18 and the spiral body member 20 causes the posts 46 to follow both the spiral tracks 44 and the longitudinal slots 38 thereby raising or lowering the cup member 16 according to the direction of rotation. As shown in FIG. 3, the cup member 16 has ribs 50 which project inwardly from side wall 52 and aid in retaining a lipstick mass (not shown) in position.

Referring again to FIG. 2, the outer body member 22 can be constructed of any desired material, such as metal or plastic. In the preferred embodiment, the body member 22 is constructed of a metal, such as brass, and surrounds the spiral body member 20 thereby providing a decorative cover therefor. It should be understood that the spiral body member 20 and the outer body member 22 are rotatable together and this two-piece structure can be termed an outer sleeve. It is contemplated by this invention that the outer sleeve can be a two-piece structure as shown or, alternatively, a one-piece structure.

The present invention is particularly directed to the central ring member 26. As best appreciated from FIG. 2, the ring member 26 has a cylindrically-shaped inner opening 50 which at least partially surrounds the outer body member 22 and is secured to one end of the base member 28. In the present embodiment, where the base member is of a hexagonal shape, the central ring member has six surfaces 52 with projections 54 thereon which interact with a corresponding inner surface 56 of the base member 28 to secure the ring member by a interference fit. The ring member also includes a relatively flat surface 58 which rests against the upper edge 60 of the outer body member 22, as best seen in FIG. 3.

Figure 4:
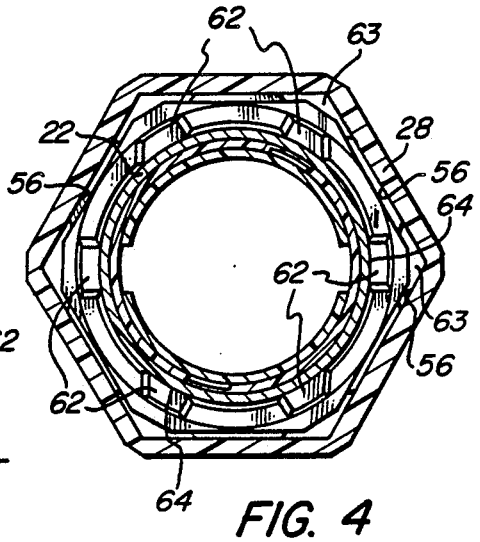
FIG. 4 is a view through 4—4 of FIG. 3.

The ring member includes a plurality of projecting elements 62 which form an important aspect of the present invention. These elements are located at the intersection of the flat surfaces 52 and are thereby received within the base member 28 so as to be disposed in the area 63 of the intersection of the flat inner surfaces 56. As seen in FIG. 4, the projecting elements are not confined by the walls 56 and therefore can move to accommodate variations in the circumference of the outer body member 22 as will be explained hereinafter. The projecting elements 62 extend from one end of the ring member 26 and have an inner surface 64 which engages at least a portion of an outer surface 66 of the outer body member 22. The projecting elements 62 are formed of a resilient material which provide a radial force on the outer body member whereby an approximately constant torque is required to enable relative rotation between the outer body member 22 and the ring member 26.

The ring member 26 is preferably constructed of a plastic material such as, for example, polypropylene which provides a smoothness of rotational action since the engagement with the outer member, which can be formed of metal, is effectively self-lubricating. The projecting elements are sized to apply a circumferentially continuous and uniform predetermined level of light axial squeezing preload against the outer body member 22.

A noteworthy aspect of the present invention lies in the construction of the inner body member 18, the outer body member 22 and the slidable cup 16. These components are sized to substantially minimize frictional engagement therebetween so that rotation of the base member 28 with the affixed inner body member 18, with respect to the outer body member 22 causes the slidable cup 16 to move between the protracted position and the retracted position without creating any noticeable swivel torque as was typically present in the prior art embodiments. Instead, a unique contribution of the present invention is to provide the quality feel through the metal to plastic engagement of the projecting elements 62 with the outer surface of the outer body member 22.

Placement of the closure cap 12, as seen in FIG. 1, locks the same to the central ring member, thus exposing no access to the outer tubular member 22 as long as the cap 12 is in place.

The described torsional drag attributable to a controlled axial squeeze of biased elements 62 against surface 66 will be seen as an advantage to the user, particularly as the cosmetic substance becomes more consumed, in that retraction of the cosmetic substance back into the container need not be retraction to the bottom of the actuating cams. The described keying to the inner tubular member 18 and rotational braking of the outer tubular member 22 will be seen to be effective whatever the carrier position when the cosmetic substance is deemed to be adequately retracted.

The patents disclosed herein ar incorporated by reference in their entireties herein.

It is apparent that there has been provided in accordance with the present invention a lipstick container which satisfies the objects, means, and advantages set forth hereinabove. While the invention has been described in combination with the embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A lipstick container comprising:

(a) an inner body member having a lower portion and an upper tubular portion;

(b) an outer body sleeve at least partially surrounding said tubular portion of said inner body member and mounted thereon for relative rotation thereabout;

(c) a base member having a wall extending along and at least partially surrounding said outer body sleeve and being in fixed engagement with said inner body member;

(d) a slideable cup adapted to carry a lipstick mass, said cup received in said tubular portion whereby relative rotation between said inner body member and said outer body sleeve moves said slideable cup between a protracted position and a retracted position; and (e) a ring member at least partially surrounding said outer body sleeve and being secured to said base member;

(1) said ring member including a plurality of resilient friction means projecting therefrom for biased engagement against at least a portion of an outer surface of said outer body sleeve to provide a radial force on the outer body sleeve whereby an approximately constant torque is required to enable relative rotation therebetween.

2. The lipstick container in accordance with claim 1 wherein said projecting resilient friction means are deployed with at least one pair of opposed land surfaces on inside surfaces thereof creating the biased engagement relationship between said friction means and said outer body sleeve.

3. The lipstick container in accordance with claim 2 wherein said plurality of projecting resilient friction means surrounds at least an axial portion of said outer body sleeve.

4. The lipstick container of claim 3 wherein said plurality of projecting resilient friction means comprise are disposed in said base member without contacting the wall thereof.

5. The lipstick container of claim 4 wherein said tubular portion of the inner body member has at least one longitudinal extending slot formed therethrough and extending to the upper end thereof.

6. The lipstick container of claim 4 wherein said extending base wall at least partially surrounding the outer sleeve includes a plurality of planar walls connected at their edges in a polygonal shape, and said ring member is mounted at the upper end of said wall with the resilient friction means projecting downwardly and disposed at the intersecting of the planar walls of said base member.

7. The lipstick container in accordance with claim 1 further including a cover removably positioned over said outer body sleeve, said cover and said base member being in assembly when said cover is fully seated on said base member.

8. The lipstick container of claim 1 wherein said friction means are plastic.

9. The lipstick container of claim 1 wherein the outer body sleeve has a metal outer surface.

10. The lipstick container of claim 9 wherein the resilient projecting friction means are plastic.

11. The lipstick container in accordance with claim 10 wherein said outer body sleeve includes a spiral body member and an outer body member thereover.

12. The lipstick container of claim 11 wherein the outer body member is metal.

* * * * *